US008353713B2

(12) United States Patent
Hofer et al.

(10) Patent No.: US 8,353,713 B2
(45) Date of Patent: Jan. 15, 2013

(54) CONTROLLED DISCHARGE CONNECTOR LEAD

(75) Inventors: Richard A. Hofer, Gardner, KS (US); Patrick D. del Castillo, Olathe, KS (US)

(73) Assignee: Castle Creations, Inc., Olathe, KS (US)

( * ) Notice: Subject to any disclaimer, the term of this patent is extended or adjusted under 35 U.S.C. 154(b) by 52 days.

(21) Appl. No.: 12/874,867

(22) Filed: Sep. 2, 2010

(65) Prior Publication Data

US 2012/0058675 A1 Mar. 8, 2012

(51) Int. Cl.
*H01R 13/53* (2006.01)

(52) U.S. Cl. ..... 439/181; 439/851

(58) Field of Classification Search ..... 439/181, 439/842, 843, 851–857
See application file for complete search history.

(56) References Cited

U.S. PATENT DOCUMENTS

| | | | | |
|---|---|---|---|---|
| 4,824,377 | A | 4/1989 | De Burro | |
| 5,591,039 | A * | 1/1997 | Matthews | 439/181 |
| 5,618,196 | A | 4/1997 | Biswas | |
| 6,068,498 | A * | 5/2000 | Strack | 439/181 |
| 6,151,202 | A | 11/2000 | Mueller | |
| 6,762,376 | B2 * | 7/2004 | Nakamura et al. | 200/60 |
| 6,848,922 | B2 * | 2/2005 | Coughlan et al. | 439/181 |
| 6,908,348 | B2 * | 6/2005 | Zhao et al. | 439/845 |
| 7,140,247 | B2 | 11/2006 | Forgue | |
| 7,387,548 | B2 * | 6/2008 | Takehara et al. | 439/843 |
| 2010/0210151 | A1 * | 8/2010 | Niles et al. | 439/851 |

OTHER PUBLICATIONS

IDES—The Plastics Web, Ultraform® N 2320 C BK120 Q600 datasheet, Dec. 15, 2009, 1 page, www.ides.com.

* cited by examiner

*Primary Examiner* — Thanh Tam Le
(74) *Attorney, Agent, or Firm* — Shook, Hardy & Bacon L.L.P.

(57) ABSTRACT

When a hobby enthusiast has recharged the battery for a remote controlled vehicle, such as a scale facsimile automobile, boat, helicopter or airplane, the battery must be connected again to the vehicle drive system, to provide power. This operation is typically performed by connecting each lead of an electronic speed controller to each corresponding lead of the battery, through a removable barrel receptacle lead and a mating barrel plug lead respectively, attached to each corresponding lead. An improved connector lead is described herein that protects components that may be attached to either lead in a connection. The charge dissipates in a resistive member that is physically coupled to a conductive member to form at least in part a first lead. When an improved lead is connected to a mating lead, the connection initially provides a charge dissipation path through the resistive member, but subsequently provides a bypass, current carrying conductive path around the resistive member from one component to another. By making use of an improved connector, electrical components are protected, not only from hot-swap current, but also from electrostatic discharge in general.

12 Claims, 12 Drawing Sheets

CONTROLLED DISCHARGE CONNECTOR LEAD

BACKGROUND

Electrical connectors are a vital, but an often overlooked part of our modern technological world. Connector design typically addresses mechanical requirements: being easy to use, durable, reliable, and safe. Connector design also typically is adapted to the electrical requirements of the application, e.g., having leads that are sized appropriately for the current that the connector will carry.

Electrostatic discharge (ESD) is one concern of electrical connector design. Invisible damage may be done through ESD to some electronic components, such as capacitors, transistors, etc., that are an integral part of integrated circuit components and circuit board components in modern electronic devices. Such damage needs to be prevented even before electronic devices themselves are assembled. Technicians handling separate components, such as transistors, capacitors, circuit cards, and integrated circuits, are urged to keep electronic components in a conductive material lined static-proof bag to protect them from inadvertent ESD before they are assembled into electrical devices and products. The ESD problem is typically addressed in connector design. Even when neither electronic device being connected through a connector has a power source, there can be an ESD event for one or more of the leads of the connector. This is possible because a different charge potential may exist between the two devices when they are connected.

The problem of sudden charge flow also needs to be addressed when "hot-swapping", that is, connecting at least two components when one or more of the devices being connected with the connector has an internal or external power source providing power at the time that the connector is connected. The power source provides a means of creating a charge differential between the two components being connected whether the power source is a direct current (DC) or an alternating current (AC) source. Two leads that come in contact during a hot-swap may result in rapid discharge and potential damage to components coupled to the leads. Hot-swapping is very common today since battery powered devices are so plentiful. The installation of even a nonrechargeable battery is a hot-swap event. When the battery is rechargeable, and there is still some charge left in the battery, the connection of an unplugged charging power adapter to a connector is itself a hot-swap event. When a passively powered device is connected, for example through an Universal Serial Bus (USB) connector, plugging the passive device into the connector is a hot-swap event. Likewise, hot-swap connectors may be used for components or devices, such as laptop computers, cordless phones, cell phones, portable digital assistants, electronic notebooks, cell phones, game controllers, and remote control vehicles.

SUMMARY

A lead of a connector is an internal or external protrusion of a connector that extends in the direction of a mating connector and that makes physical contact with a mating lead during connection of the connector. A resistive member is incorporated into the physical makeup of a connector lead by physically coupling a resistive member to a conductive member to form at least in part an improved connector lead. The conductive member has a conductive interface, such as a solder joint well, that is used to electrically join the connector through an electrical conductor, such as a lead, trace or wire to a component. Exemplary components include a capacitor, integrated circuit, memory chip, battery, computer chip, transistor, etc. A mating connector is electrically joined similarly to another component. When the two mating connector leads are connected, the improved connector at first provides a charge dissipation path through the resistive member, but subsequently provides a bypass, current-carrying, conductive path around the resistive member from one component to another. Embodiments provide an improved receptacle, plug, tab, slot, barrel plug, barrel receptacle, finger spring, finger pad, pin or pin hole connector lead. Embodiments provide a kit including an assembly consisting of an improved connector lead and a mating connector lead. Embodiments provide an electrical component, such as a battery, electronic speed controller (ESC), a computer, or a USB device incorporating an improved lead into the component, so that an improved lead is sold as part of an improved component. Embodiments provide an improved electrical device incorporating an improved lead into a product, such as a game, USB device, computer, cell phone, digital assistant, electrical gadget, toy, monitor, printer, remote control vehicle, etc. Embodiments incorporate the resistive member into the tip of a lead. Embodiments incorporate the resistive member into the middle of a lead. Embodiments incorporate an insulating jacket that is adjacent to an external conductive member, to prevent inadvertent connection or discharge, and in some embodiments, to aid retention of the resistive member. In some embodiments improved leads are joined into arrays to form an improved multi-conductor connector assembly. Embodiments provide an insulating guide. Embodiments provide a conductive ground shield.

Embodiments form the resistive member from a polymer. of suitable resistance. Embodiments determine a suitable resistance value of the resistive member based on insertion time and actual or likely input capacitance, and so bound the resistance value to be used. Embodiments match the resistance value of the resistive member by determining a range within which the resistance of the resistive member is either tightly or approximately matched to a likely or actual input capacitance of an application.

An assembly process provides a charge dissipation path that is used during connection of an electrical device. A first connector lead is assembled by physically coupling a first resistive member to a first conductive member, so that when the first connector lead is connected to a mating connector lead, the resistive member initially dissipates charge in a charge dissipation path through the resistive member, but the connector lead subsequently provides a conductive path that bypasses the resistive member. The conductive member of the improved lead is joined to an electrical component to provide a current carrying conductive path for an electrical device. A first mating connector is joined to a second component. The components are protected when a first improved lead is connected to the mating connector lead. In some embodiments a second connector lead is formed by joining a second conductive member to an electrical component and physically coupling a second resistive member to the second conductive member to form a second connector lead. In some embodiments an insulating jacket is installed on an exterior conductive region of an improved lead. In some embodiments an insulating guide is provided that is adjacent to the first improved lead so that the insulating guide aids in physically aligning the first connector lead to the first mating connector lead. In some embodiments a conductive shield is provided that aids in physically aligning a first improved lead and a mating lead.

BRIEF DESCRIPTION OF THE DRAWINGS

The present invention is described in detail below with reference to the attached drawing figures, wherein.

DETAILED DESCRIPTION

The subject matter of the present invention is described with specificity herein to meet statutory requirements. However, the description itself is not intended to limit the scope of this patent. Rather, the inventors have contemplated that the claimed subject matter might also be embodied in other ways, to include different steps or combinations of steps similar to the ones described in this document, in conjunction with other present or future technologies. Moreover, although the terms "step" and/or "block" may be used herein to connote different elements of methods employed, the terms should not be interpreted as implying any particular order among or between various steps herein disclosed unless and except when the order of individual steps is explicitly described.

Figure 1A:
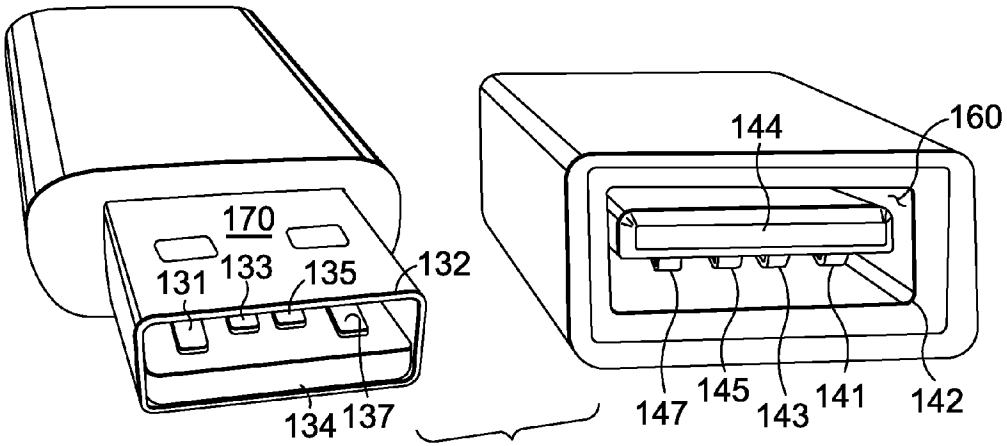
FIG. 1A presents a conventional substantially rectangular receptacle and a mating plug connector that may encounter destructive rapid discharge.
Figure 1C:
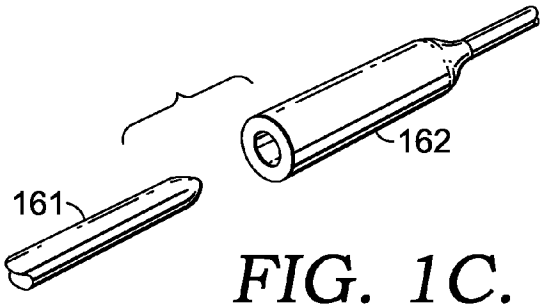
FIG. 1C presents a conventional pin connector lead and a mating pin hole connector lead that may encounter destructive rapid discharge.

Turning now to FIGS. 1A-1F, there are depicted therein a number of views of different connector leads that may encounter unwanted, damaging rapid charge or discharge upon connection. Leads of such connectors typically fashion a conductive path purely from conductive materials, such as metals or alloys of copper, silver, tin, lead, etc. FIG. 1C shows a pin lead 161 and a mating pin hole lead 162. When pin 161 is electrically coupled to a first electrical polarity component, such as a battery 701, and pin hole lead 162 is electrically coupled to a second electrical polarity component, such as a computerized device 702, the insertion of pin lead 161 into pin hole lead 162 results in a rapid inrush of charge into the computerized controller that may erode or damage connector surfaces and/or electrical components such as those within the computer controller. A charge flows between a first polarity component and a second polarity component when there is a charge differential between the first and second component. "Polarity" therefore refers to a difference in charge potential that results in charge flow. Under high charge capacity conditions, there may be several severe undesirable effects, as discussed more fully below when a conductive lead, such as pin lead 161, gets close to a conductive pin hole lead 162.

Figure 1B:
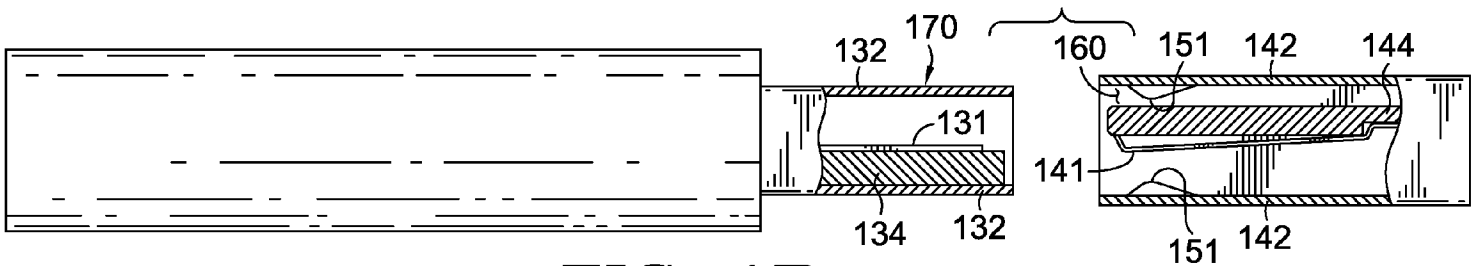
FIG. 1B presents a side elevation view of the connectors of FIG. 1A to expose the internal structures of the connectors.

Even when a connector application has relatively low charge capacity, and uses an ESD design, there still may be a negative effect from rapid inrush of charge. Consider for example, a typical substantially rectangular connector, such as Universal Serial Bus (USB) connectors, depicted in FIG. 1A and FIG. 1B. Typically, plug 170 shown in FIG. 1A has a substantially rectangular grounding shield 132, and an insulating guide 134 physically adjacent to finger pads 131, 133, 135, and 137. A mating receptacle 160 is shown in FIG. 1A having a substantially rectangular grounding shield 142, an insulating guide 144, and finger springs 141, 143, 145 and 147. The finger pads 131, 133, 135, 137, and finger springs 141, 143, 145, and 147 in the USB leads are typically coupled to electronics components, such as a battery, power supply, line drivers, transistors, memory chips, etc., which may suffer degradation from rapid inrush of charge. Coupling, attaching, or joining leads to components is typically performed by forming a solder joint between the conductive material of a connector lead and the conductive material of a component, such as a circuit board, computer, computer board, battery, or a component lead therefrom. Other means of joining include making screw terminal connection, forming a pressure connection, forming a twist-on connection, forming a crimp connection, etc. When a receptacle 160 is mated to a plug 170, the contacts formed are illustrated in FIG. 1B. The ground shield 132 makes electrical contact with shield springs 151 providing an ESD charge path for a static charge differential between receptacle device and plug device. For example, a USB device may include: a computer, a laptop, an mp3 player, a docking station, a hub, a card reader, a flash drive, an external hard drive, a web cam, a speaker, an infrared adapter, an 802.11 adapter, an audio interface, a mouse, a keyboard, a trackball, a game controller, a gadget (e.g. for heating slippers, gloves, beverages, etc.), and a charger. Upon insertion, the four finger pads 131, 133, 135, and 137 make electrical contact respectively with the four finger springs 141, 143, 145, and 147. As shown in FIG. 1B, a typical finger spring, such as finger spring 141, makes physical metal to metal contact with finger pad 131. As shown in FIG. 1A, the outer mating connection lead pairs 137 and 147 (typically VBUS); and 131 and 141 (typically GND), make contact forming a power supply circuit. A circuit is closed once the two pairs of leads have both made electrical contact. A charge differential necessarily exists in many such applications, such as when a USB receptacle 160 is coupled to a passive component. Therefore the charge may be rapidly discharged from a powered receptacle or jack 160 to a passive component, such as a USB flash drive, which is coupled to plug 170. When the second pair of mating leads makes contact, the components attached to the leads may be at least incrementally degraded by a sudden rush of charge.

Figure 1D:
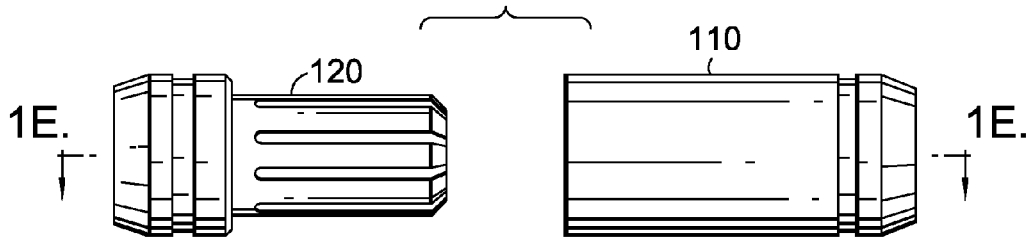
FIG. 1D presents a plan view of a conventional receptacle barrel lead and a mating plug lead that may encounter destructive rapid discharge.
Figure 1E:
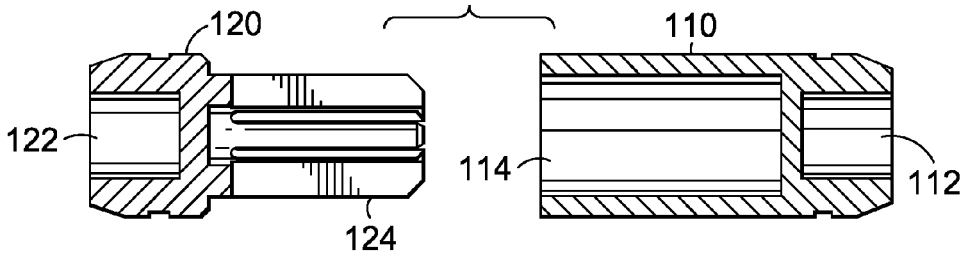
FIG. 1E presents a cross-sectional view of the connector leads of FIG. 1D, taken generally along the plane 1E-1E of FIG. 1D, in the direction of the arrows.
Figure 1F:
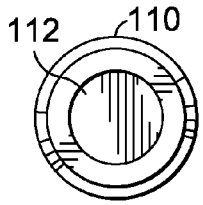
FIG. 1F presents an end view of a conventional receptacle barrel lead.
Figure 9:
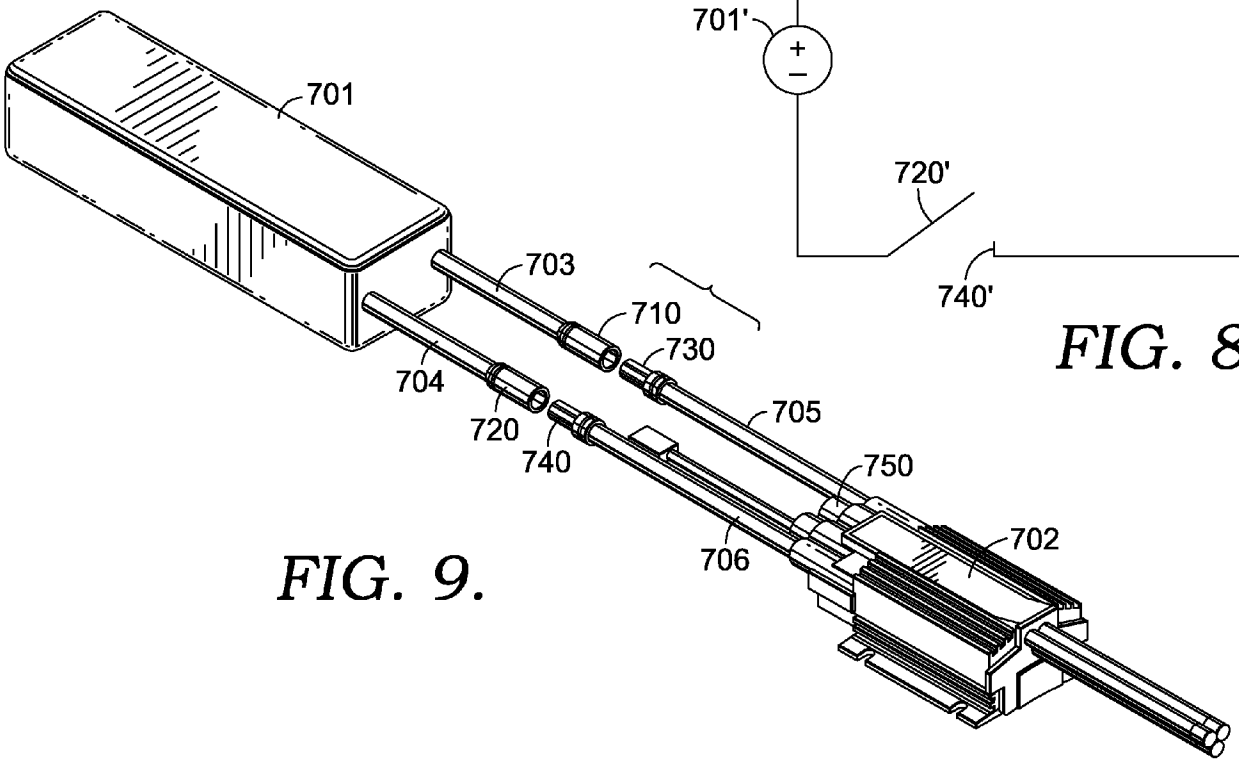
FIG. 9 is a depiction of the installation of a battery in a hobby application which is performed by connecting one or more improved leads to mating leads that are coupled to an electronic speed controller.

By way of illustration, where the effect may be relatively severe, there is shown in FIG. 1D-1F various views of a conventional barrel connector lead 110 and a mating barrel plug lead 120 that are amenable to a hobby or robotic vehicle application, such as that shown in FIG. 9. FIG. 1D presents a plan view of a barrel receptacle lead 110 and a plan view of a barrel plug lead 120. FIG. 1E presents a cross-sectional view of the connectors of FIG. 1D generally taken along the plane 1E-1E in the direction of the arrows. This cross-sectional view shows that barrel plug lead 120 is fashioned of conductive material, and has a conductive interface 122 capable of forming a solder joint with a lead from an electrical component. Plug lead shaft 124 inserts into receptacle lead cavity 114. The cross-sectional view of conventional lead 110 shows that lead 110 is fashioned of conductive material, and has a conductive interface 112 capable of forming a solder joint with a lead from an electrical component. Receptacle lead 110 also has receptacle cavity 114 for receiving barrel plug lead 120 to make an electrical contact between receptacle lead 110 and plug lead 120. Conductive interfaces, such as conductive interfaces 112 and 122 also shown in FIG. 1F, are typically available in 3.5 mm, 4 mm, 5.5 mm, 6.5 mm and 8 mm diameter channels.

In FIG. 9, a charged battery 701 is illustrated being connected to an electronic speed controller (ESC) 702. An ESC is a device that controls the speed of a motor using electronic components, such as Mosfets, Random Access Memory (RAM), capacitors, resistors, and an imbedded microprocessor running firmware and/or software. An ESC typically controls the timing and duration of pulses that apply power to a motor to control direction of rotation, speed of rotation, and acceleration of a rotor that is engaged with the motor. An input capacitor 750 is typically sized for the ESC 702 based on the battery 701 and current requirements. In a typical application input capacitor 750 is 1.6 millifarads for a relatively high capacity battery at 50 Volts; though voltages as high as 90 volts are also common. In this application, when connector leads 710 and 720 are of conventional type, such as lead 110, and connector leads 730 and 740 are of conventional type such as lead 120, rapid charge flow can have negative effects. First of all, if there is a charge differential between the battery 701 and the ESC 702, then an ESD charge flow will result when a first lead 710 begins to connect with lead 730. After lead 730 is seated into lead 710, the static charge differential is equalized. Secondly, when lead 720 is subsequently about to be connected to a mating lead 740, there may be unwanted effects of a hot-swap connection. For example one or more of the following may occur: a sound similar to a gunshot, a current that momentarily exceeds the capacity of components (such as capacitor 750), a current that causes the material of a component to melt, a current that causes degradation of components such as capacitor 750, destruction of components (such as capacitor 750), fouling of one or more leads, melting of one or more leads, etc.

Figure 2A:
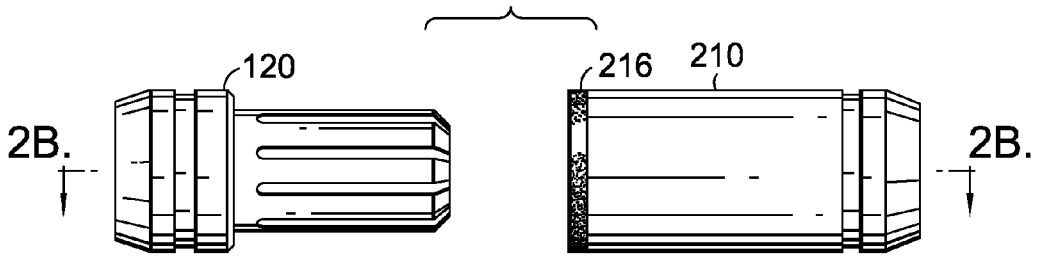
FIG. 2A presents a plan view of an improved receptacle barrel lead and a mating plug lead.
Figure 2B:
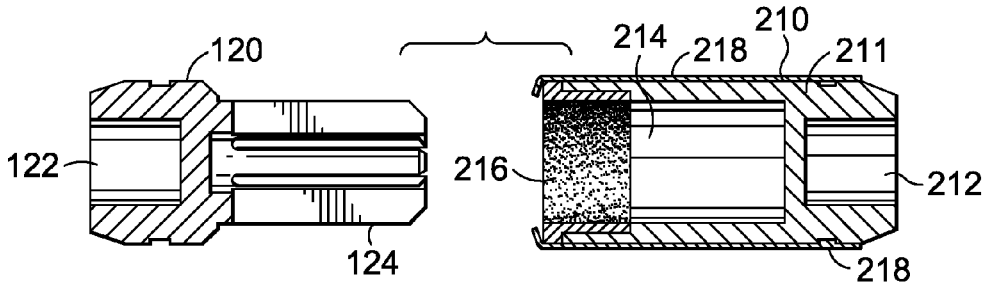
FIG. 2B presents a cross-sectional view of an embodiment of the connector leads of FIG. 2A, taken generally along the plane 2B-2B of FIG. 2A, in the direction of the arrows.
Figure 2C:
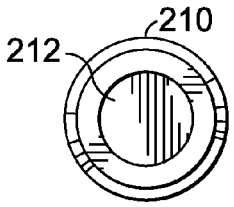
FIG. 2C presents the solder-joint end view of an improved receptacle barrel lead.
Figure 2D:
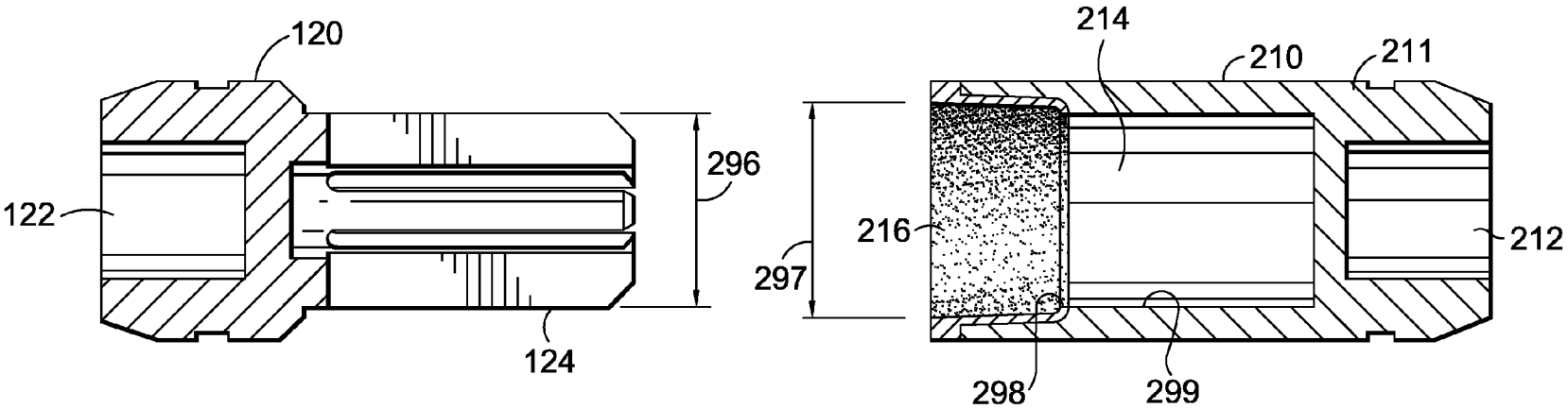
FIG. 2D presents a cross-sectional view of an alternative embodiment of the connector leads of FIG. 2A, taken generally along the plane 2B-2B of FIG. 2A, in the direction of the arrows.
Figure 3:
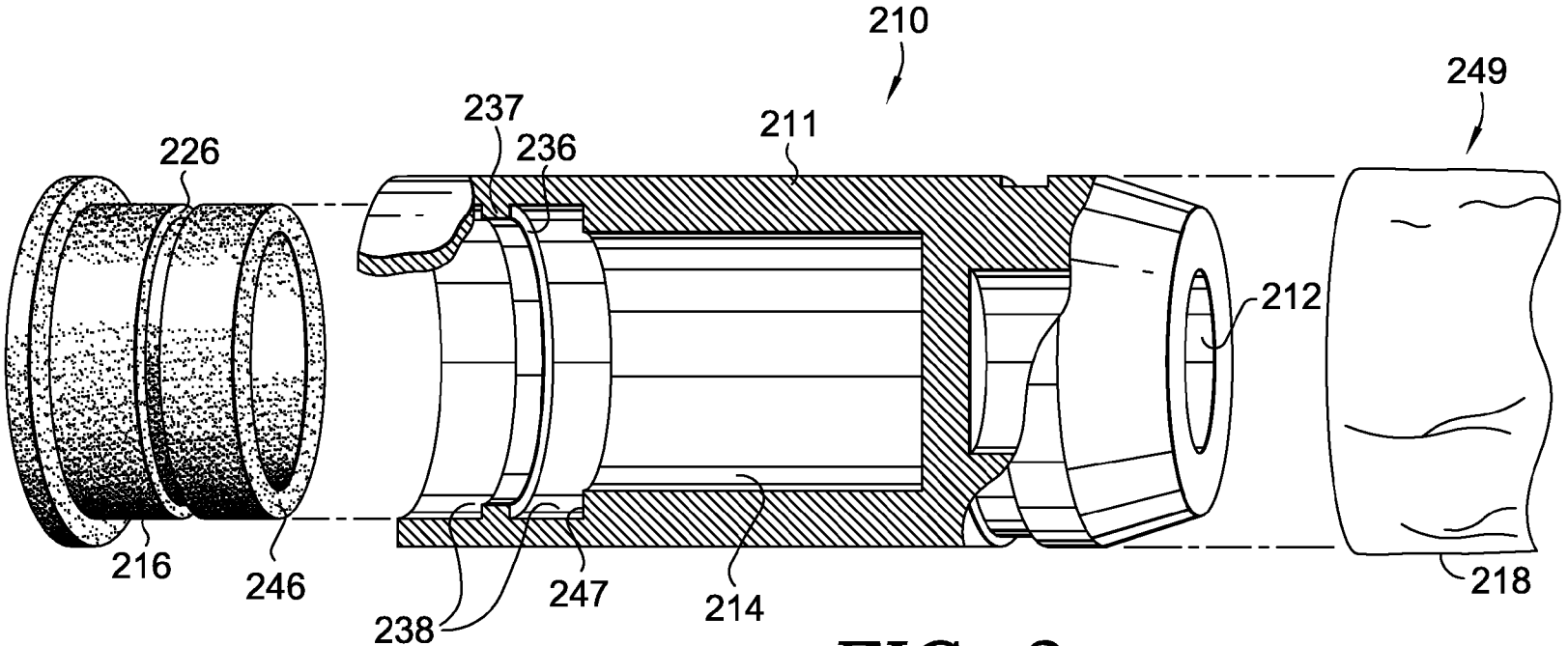
FIG. 3 presents a cutaway and partial cross-sectional enlarged view of the improved receptacle barrel lead of FIG. 2A.

Turning now to FIGS. 2A-2D, and FIG. 3, there are shown several views of an improved barrel receptacle lead 210 and a mating lead 120. A resistive member 216 is physically coupled to a conductive member 211 to form a connector lead that protrudes from the conductive member 211 in the direction of a mating connection. The physical coupling shown in FIG. 3 is the physical insertion of resistive member 216 into a channel 238 designed to conform to the exterior region of resistive member 216 so as to provide electrical contact between 216 and 211. Retaining groove 226 on resistive member 216 mates to retaining ring 236 to keep the resistive member in place as a plug shaft 124 (FIG. 2B) is inserted first into the physically coupled combination of 216 and 211, and removed again. Retaining ring 236 has a profile 237 with two right angles to match the profile of retaining groove 226. The profile of one or more of groove 226 or ring 236 could alternatively make use of a differently shaped profile 237; alternatively using an elliptical shape, triangular shape, etc. In the embodiment shown, the foot 246 of resistive member 216 mates to the seat 247 of conductive member 211 at a right angle to the exterior. Other embodiments provide a tapered angle, such as 45 degrees. In the embodiment shown in FIG. 3, the resistive member is retained by retaining ring 236. Means of retention include one or more of the means shown in FIG. 3, mechanical retention by an exterior insulator 218 as shown in FIG. 2B, compression connection, screw connection, conductive adhesive, plating, etc. The interior diameter of resistive member 216 after insertion is approximately equal to the interior diameter of channel 214 to provide substantially constant contact between plug shaft 124 (FIG. 2B) and plug receptacle 210 (FIG. 2A) upon insertion. In some embodiments, a resistive member, such as resistive members 216 (FIG. 2B), 316 (FIG. 4B), 416 (FIG. 5B), 524 (FIG. 6B), or 849 (FIG. 10B), may be formed from a low resistance Acetal Homopolymer (POM), such as Ultraform® N2320 C BK120 Q600, manufactured by BASF corporation or an equivalent. Embodiments form the resistive member from any material that exhibits desirable dissipative properties such as ceramic material, semiconductor material, polymeric material, etc.

FIG. 2A shows an improved barrel receptacle lead 210 having resistive member 216, and a mating conventional plug connector 120. FIG. 2B is a cross-sectional view of the leads in FIG. 2A, taken along the plane 2B-2B, in the direction of the arrows. As shown in FIG. 2B, conductive member 211 has a conductive interface 212 that can be joined to an electrical component, such as component 701 (FIG. 9), or 702 (FIG. 9), e.g. through a solder joint, to form a current carrying path in an electrical device. Other conductive interfaces, such as metallic leads, or other types of conductive joints are contemplated in embodiments of the improved connector lead. FIG. 2B also shows an optional (not shown in FIG. 2A) exterior insulating jacket in the form of an insulating "shrink-tube" sheath 218 that encompasses an exterior region of conductive member 211 to prevent inadvertent conductor-to-conductor contact, and in the embodiment of FIG. 2B, to aid retention of resistive member 216. FIG. 2C depicts an end view of the improved barrel receptacle 210 showing the conductive interface 212. FIG. 2A shows a plan-view of the improved barrel receptacle 210. FIG. 3 shows the sheath 218 prior to assembly in which it has not yet contracted due to the application of heat.

FIG. 2D is a cross-sectional view of an alternative embodiment of the leads in FIG. 2A, taken along the plane 2B-2B, in the direction of the arrows. As shown in FIG. 2D, the diameter of shaft 124 indicated by distance 296 is chosen to provide constant electrical contact with the conductive member 211, so that distance 296 is approximately equal to the diameter of channel 214. In the embodiment depicted in FIG. 2D, the opening of resistive member 216 at the end of the resistive member which first receives shaft 124 upon insertion has slightly larger diameter indicated by distance 297. The diameter of resistive member 216 tapers from a diameter of distance 297 at one end of the resistive member to a diameter substantially equal to distance 296 at location 298 within the resistive member. In some embodiments distance 297 is approximately 1 mm larger than distance 296. In some embodiments the outer diameter of barrel 210 is increased slightly, especially in the region surrounding the resistive member 216, increasing the thickness of the shell of conductive member 211. In some embodiments a portion of the resistive member 216 of about 1 mm length has diameter approximately equal to distance 296.

Returning to the example shown in FIG. 9, consider how an improved connector lead, such as lead 210, improves performance of the connector upon connection. A lead, such as lead 210, is coupled to a component, such as battery 701, by soldering to it lead 703 so that lead 710 is of an improved type, such as lead 210. A second connector lead, such as lead 120, is soldered to lead 704, so that lead 730 is of a conventional type such as lead 120, thus electrically joining lead 730 to ESC 702. The first connection illustrates how the improved connector resists and dissipates ESD. As connector lead 710 is connected to mating connector lead 730, connector lead 710 initially provides a charge dissipation path from plug shaft 124 through resistive member 216, through conductive member 211 from ESC 702 to battery 701. Thus the resistive member serves to dissipate charge, and to divert the sudden rush of charge by heating the resistive member slightly rather than injecting a sudden ESD inrush of charge that may degrade electrical components within the ESC such as, capacitors, processor chips, line drivers, RAM, etc. When a plug shaft 124 (FIG. 2B) on lead 730 is subsequently further inserted into connector 710, the shaft 124 (FIG. 2B) begins to make contact with channel 214 (FIG. 2B) within improved connector 710 thereby providing a bypass, current carrying conductive path from lead 703 through conductive member 211 to shaft 124 of plug 730 to lead 705 from the battery 701 to the ESC 702.

After having achieved electrical connection of lead 703 to lead 705, an improved connector lead 720, such as lead type 210, further protects connectors 720 and 740 as well as the components such as capacitor 750 within a device, such as ESC 702. Improved connector 720, of a type such as lead 210, is joined to lead 704 through a solder joint. A conventional plug lead 740, of a type such as lead 120 is joined to lead 706 through a solder joint. When improved connector lead 720, is mated to conventional connector lead 740, connector lead 720 initially provides a charge dissipation path from battery lead 704 through conductive member 211, through resistive member 216, through conductive plug 120 to lead 706 from battery 701 to ESC 702. When connector lead 740 is further inserted into connector lead 720, connector 720 subsequently provides a bypass, current carrying, conductive path around the resistive member 216 from lead 704 through conductive member 211 through plug lead 740 to lead 706 from battery 701 to ESC 702. When an electrical bypass path is provided, much of the charge flows through the bypass path, thus substantially bypassing the resistive member. This improvement in the second pair of connectors to be mated provides enhanced performance even for the case in which the prior electrical connection between lead 703 and lead 705 had been made using conventional leads.

Figure 8:
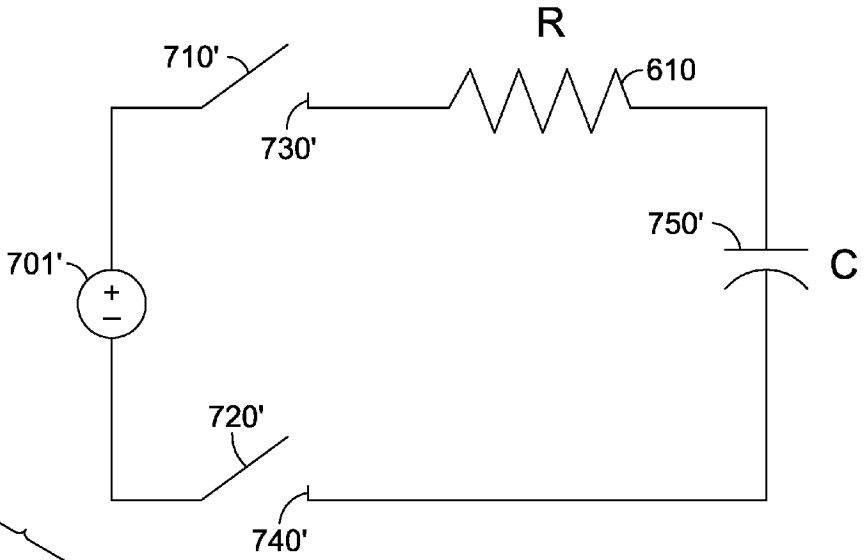
FIG. 8 presents a simplified equivalent circuit for choosing a resistance value for some embodiments of the resistance resistive member.

Continuing with the embodiment of FIGS. 2A-2C and FIG. 3, in the application of FIG. 9, FIG. 8 presents an equivalent circuit for the initial resistance upon insertion of plug 730 into receptacle 710, after plug 740 has been fully inserted into receptacle 720. For the purpose modeling the current flow of the equivalent circuit, the situation may be modeled as two ideal switches 710' and 720' of FIG. 8 that close simultaneously with corresponding idealized connectors 730' and 740'. Resistor 610 models the initial resistance encountered in the entire circuit from idealized battery 701' to idealized capacitor 750' when the resistive member 216 of the second connector begins to make contact with the second mating connector 740. Assume that for a short time, the resistance R ohms approximates a constant resistance level provided by the resistive member. Assume further that the electrical device 702 may be modeled simply as having the value of the input capacitor 750 of C Farads. The current through the resistor 610 as a function of time may be derived as shown, for example in pp. 186-188 of Nilsson, "Electric Circuits," Addison-Wesley, of Reading Massachusetts, © 1983, to be current I through resistor 610 for idealized battery 701' of voltage V, as follows:

$$I=(V/R)e^{-t/RC}$$

This equation may be used to advantage in sizing the resistance value R of the resistive member 216. If it is desired to dissipate most (5 time constants) of the charge flow in a target dissipation time of 16 ms, for a capacitor of 1.6 millifarads, then a resistance value of about 2 ohms should be used. The resistance is considered to be matched to the input capacitance when it is approximately equal to 0.003 times the reciprocal of the capacitance. This gives a decay time of approximately 15 milliseconds to reach the 5 time constant limit, when the current has dropped below 1% of its maximum value. The resistance is considered approximately matched to the input capacitance when it is within a factor of 1000 above or below the matched value (either a thousand times larger, or a thousand times smaller than the matched value). The resistance value is tightly matched to the input capacitance when it is within a factor of 10 above or below the matched value (either ten times larger or ten times smaller than the matched value). In some embodiments the resistance is bounded by a factor of the capacitance, in other words, at least the dissipation time is bounded so that it is not large enough to be cumbersome to the person attaching the connector. For example, if it is desired to have the 5 time constant decay time less than 15 seconds, then the resistance is loosely bounded by the capacitance when it is chosen to be less than 3 times the reciprocal of the capacitance. The resistance is tightly bounded by the capacitance when it is chosen to be less than 0.03 times the reciprocal of the capacitance. For example, in an exemplary USB application, the maximum input capacitance is 10 microfarads, and the minimum is 1 microfarad. Therefore a resistance is tightly bounded by the maximum input capacitance when it is chosen to be less than 3,000 ohms. The resistance is tightly matched to a capacitance of 10 microfarads when it is chosen to be between 30 ohms and 3,000 ohms.

Figure 4A:
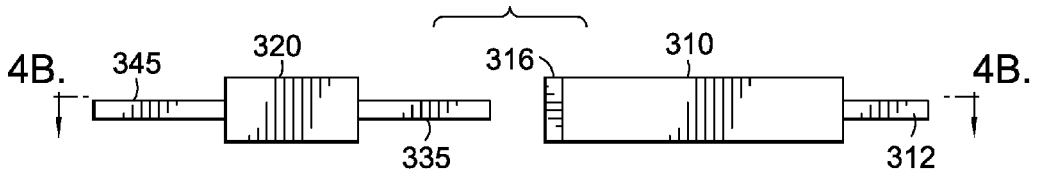
FIG. 4A presents a plan view of an improved receptacle slot lead and a mating tab lead.
Figure 4B:
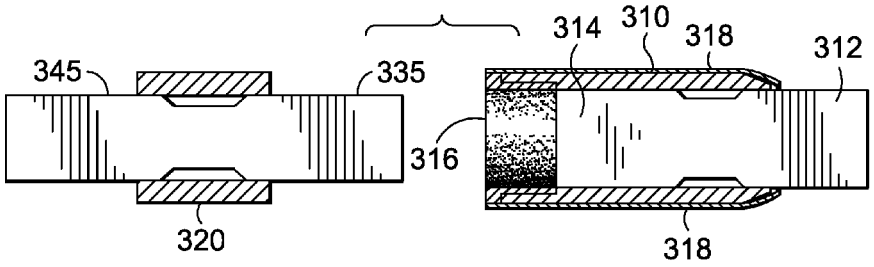
FIG. 4B presents a cross-sectional view of the connector leads of FIG. 4A, taken generally along the plane 4B-4B of FIG. 4A, in the direction of the arrows.
Figure 4C:
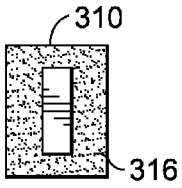
FIG. 4C presents an end view of an improved receptacle slot connector.

Turning now to FIGS. 4A-4C, there are depicted therein various views of an improved slot receptacle connector 310 and a mating tab connector 320. FIG. 4A shows a plan view of improved slot receptacle 310 having conductive tab interface 312 at one end and resistive member 316 inserted into the opposite end. FIG. 4A also depicts mating tab connector 320 with tab conductors 345 and 335. FIG. 4B shows a cross-sectional view of the leads in FIG. 4A taken along the plane 4B-4B of FIG. 4A in the direction of the arrows. A rectangular resistive member 316 physically couples to conductive member 314. An optional (not shown in FIG. 3A) insulating jacket 318 surrounds an exterior region of the connector 310. FIG. 4C presents an end view of improved slot receptacle connector 310.

Figure 5A:
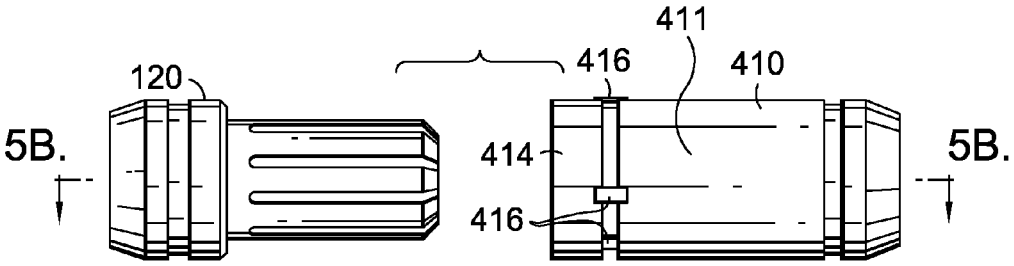
FIG. 5A presents a plan view of an alternative embodiment of an improved receptacle barrel lead connector and a mating connector lead.
Figure 5B:
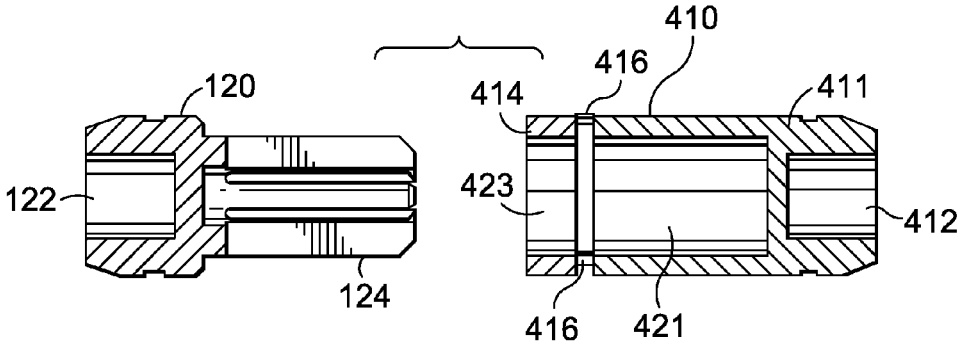
FIG. 5B presents a cross-sectional view of the connector leads of FIG. 5A, taken generally along the plane 5B-5B of FIG. 5A, in the direction of the arrows.
Figure 5C:
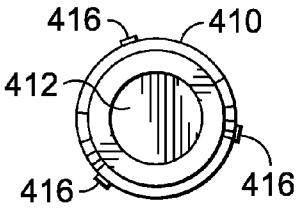
FIG. 5C presents the solder-joint end view of an improved receptacle barrel lead.

Turning now to FIGS. 5A-5D, there are depicted therein alternative embodiments of an improved barrel receptacle connector 410 and mating plug 120. FIG. 5A shows a plan view of the improved barrel receptacle 410 having conductive member 411 physically coupled to conductive ring 414 through three resistive members 416. For each resistive member 416, ribbed receiving slots in the conductive ring 414 and in the slots of conductive member 411 receive resistive member 416 during a compressive insertion of conductive ring 414 onto an assembly of conductive member 411 and the three resistive members 416. The ribs are fashioned to grip the resistive member 416 and prevent ring 414 from decoupling from barrel receptacle 410. The gap between conductive ring 414 and conductive member 411 is chosen to be large enough to prevent sparking around resistive members 416. FIG. 5C shows the electrical interface 412 of connector lead 410, and also shows the circular arrangement of the resistive members 416 used to connect conductive ring 414 to conductive member 411. Conductive ring 414 is a conductive member that is coupled to one or more resistive members and protrudes in the direction intended for mating the connector to form a front portion of connector lead 410. Embodiments replace one or two of the three resistive members 416 with insulating members, so that charge dissipates, upon connection through as little as a single resistive member 416. FIG. 5B shows a cross-sectional view of the leads shown in FIG. 5A taken generally along the plane 5B-5B of FIG. 5A, in the direction of the arrows. FIG. 5B shows electrical interface 412, and channels 423 and 421. When mating connector 120 is connected to improved barrel connector 410, initially the conductive plug shaft 124 makes contact with conductive member 414 providing a charge carrying path from conductive interface 122 through shaft 124, through conductive ring 414, through one or more resistive members 416, to conductive member 411, and thus to conductive interface 412. When shaft 124 is further inserted, making contact with channel 421, a conductive bypass path around one or more resistive members is provided from conductive interface 122 through shaft 124 to conductive member 411 and conductive interface 412.

Figure 5D:
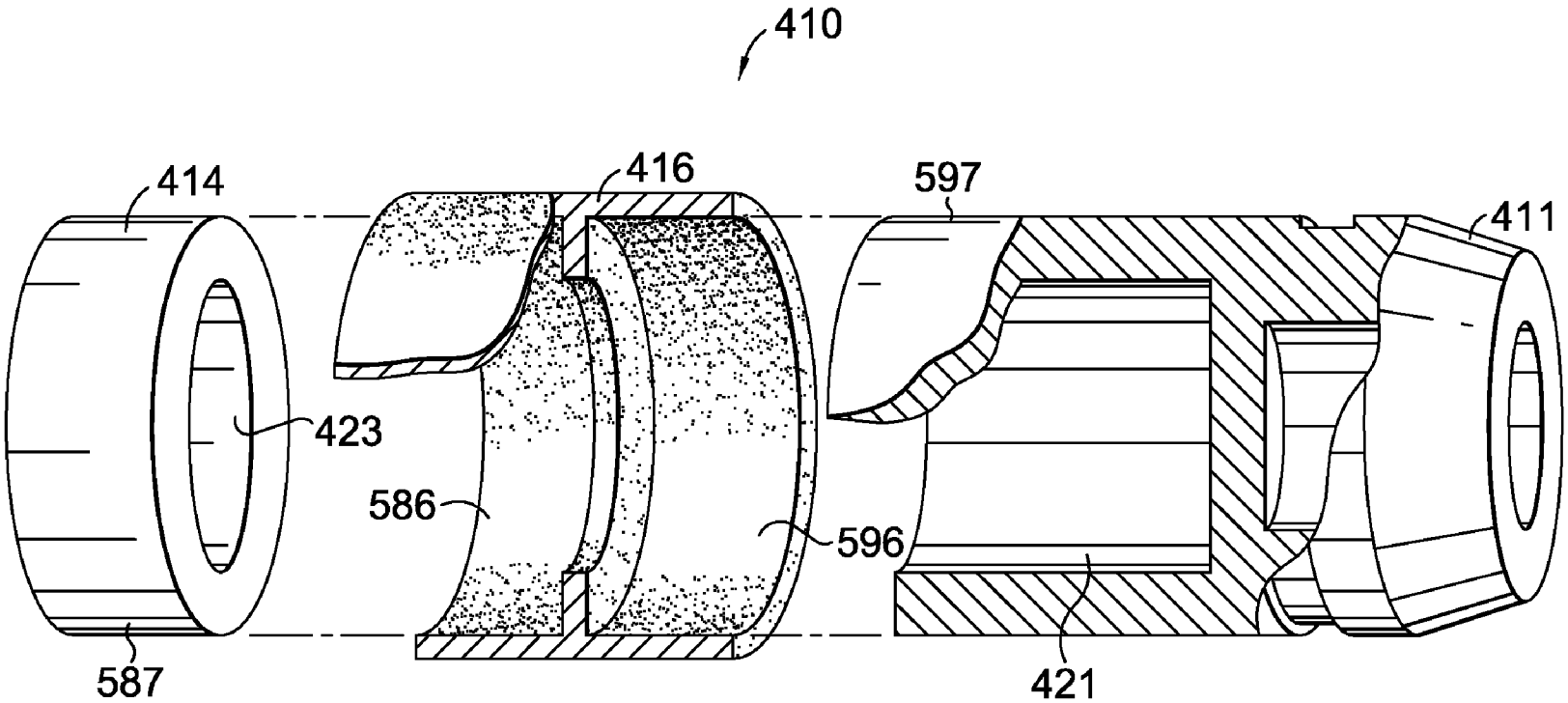
FIG. 5D presents a cutaway and partial cross-sectional view of an embodiment of the improved barrel receptacle lead of FIG. 5A.

FIG. 5D presents an alternative configuration of improved barrel receptacle lead 410. In FIG. 5D, the alternative configuration of resistive member 416 still couples physically to conductive ring 414 and to conductive member 411. In some embodiments, exterior surface 587 of conductive ring 414 has retaining ribs to mechanically couple to interior surface 586 of resistive member 416 and so to prevent ring 414 from decoupling from resistive member 416. Similarly, in some embodiments an exterior region 597 of conductive member 411 has ribs to mechanically couple to an interior surface 596 of resistive member 416 to prevent resistive member 416 from decoupling from conductive member 411. Other embodiments of mechanical coupling are contemplated such as one or more retaining rings, smooth surface contact adhesion, screw connection, conductive adhesive, plating, etc.

Figure 6A:
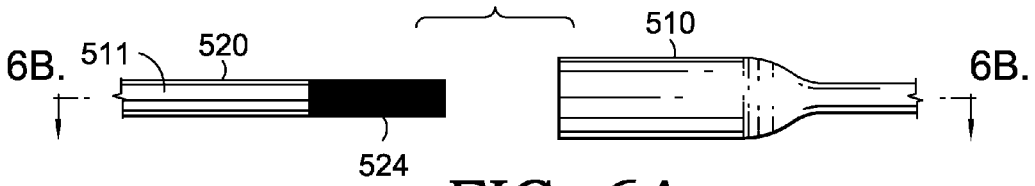
FIG. 6A presents a plan view of an improved pin connector lead and a mating pin hole connector lead.
Figure 6B:
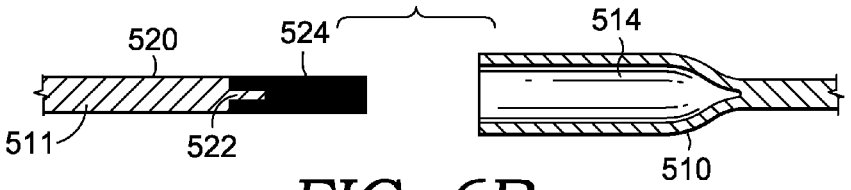
FIG. 6B presents a cross-sectional view of the connector leads of FIG. 6A, taken generally along the plane 6B-6B of FIG. 6A, in the direction of the arrows.
Figure 7:
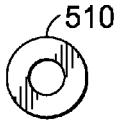
FIG. 7 presents an end view of a pin hole connector lead.

Turning now to FIG. 6A, FIG. 6B, and FIG. 7, there are depicted therein various views of an improved pin lead 520 and a mating pin hole lead 510. FIG. 6A shows a plan view of mating pin hole lead 510 and of improved pin lead 520 with resistive member 524 and conductive member 511. FIG. 7 is an end view of pin hole lead 510. FIG. 6B shows a cross-sectional view of the leads shown in FIG. 6A taken along the plane 6B-6B of FIG. 6A, in the direction of the arrows. The cross-section of lead 520 illustrates a conductive connecting protrusion 522 for physically coupling the conductive member 511 of the pin lead 520 to resistive member 524. Embodiments of the pin lead 520 form threads on the protrusion 522, and provide mating threads on the resistive member 524. Embodiments provide ribs on protrusion 522, and mating retention rings on resistive member 524 to couple resistive member 524 to the protrusion 522 of the pin conductive member 511. Embodiments provide a conductive adhesive to couple conductive member 511 to resistive member 524, applying the adhesive at least to protrusion 522. The conductive member 511, or a lead coupled thereto, is typically inserted into a conductive through-hole on a circuit-board and coupled additionally to one or more other electrical components, such as resistors, capacitors, integrated circuits, etc. Alternatively, a conductive cable lead is electrically coupled to conductive member 511, and bound together with similar cable leads that are likewise coupled to additional connectors and electrical components. When an improved pin lead 520 is inserted into a pin hole lead 510, the resistive member 524 enters channel 514 providing a charge dissipation path from conductive member 511 through resistive member 524 to conductive member 510. As the improved pin lead is further inserted, a current-carrying bypass path is provided from conductive member 511 to pin hole lead 510 substantially bypassing resistive member 524. In some embodiments, improved pin connector leads, such as lead 520, or others, described herein are gathered into arrays, and used as improved pins in available connector bodies, such as D-shell connectors, substantially rectangular connectors, and compressive circular connectors that are commonly used for electronics applications. An improved array of pin connector leads, such as lead 520, are mated with a conventional mating array of pin hole connector leads, such as lead 510. These arrays may be provided with a circular, substantially rectangular, or D-shell conductive electrical grounding shield to provide a mechanical guide and ESD protection when mating the arrays. Such an improved array, may alternatively replace the material of conductive electrical grounding shield 842 with an insulator of the same shape, such as plastic, since an ESD solution has been incorporated into each pair of pin lead 520 and mating pin hole lead 510. Embodiments of the guides are further discussed below. In another variation, the connector improvement is incorporated into the pin hole lead, and a conventional pin lead is used. In variations the connector leads are barrel leads, slot leads, finger spring leads, or finger pad leads. Optionally an insulating guide is used to align the leads upon insertion in addition to a conductive guide as also discussed further herein below.

Figure 10A:
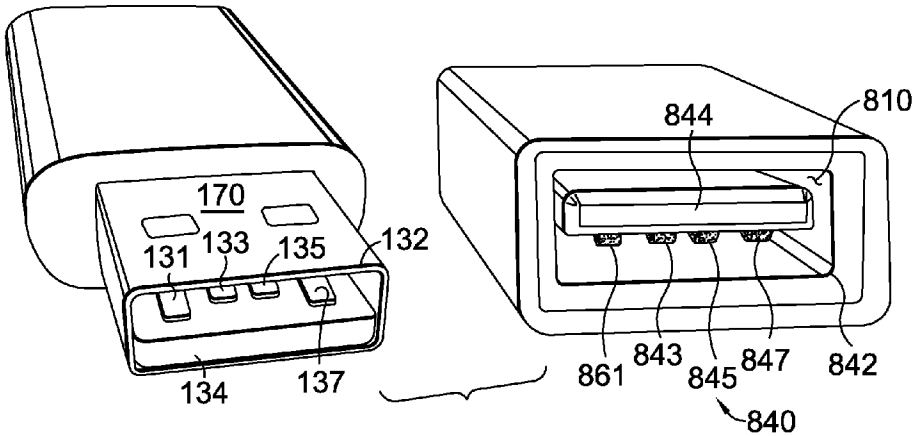
FIG. 10A presents an improved substantially rectangular receptacle and a mating plug connector.
Figure 10C:
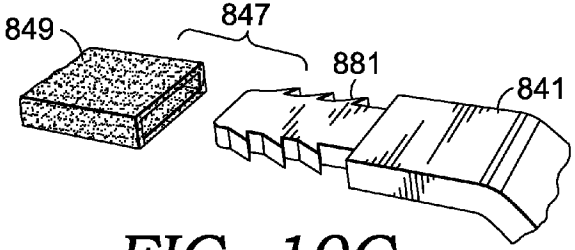
FIG. 10C presents an enlarged fragmentary perspective view of the area of location 10C in FIG. 10B.
Figure 10B:
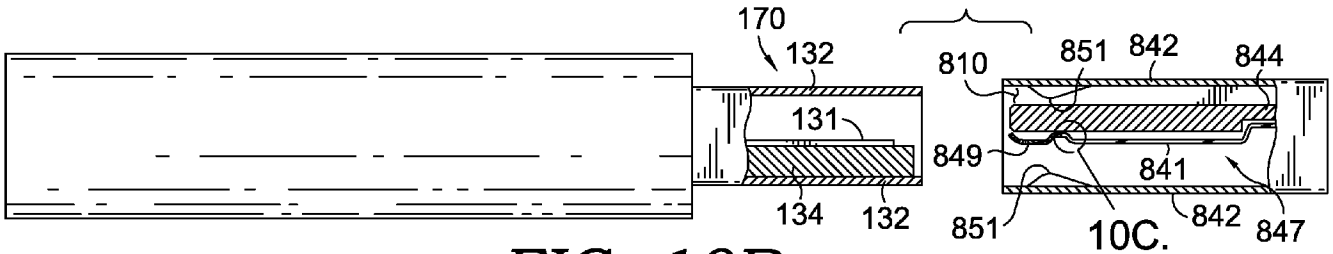
FIG. 10B presents a side elevation view of the connectors of FIG. 10A to expose the internal structures of the connectors.

FIGS. 10A-10C present views of an improved finger spring lead, such as lead 847, for use in embodiments of an improved connector, such as receptacle 810. A representative perspective view of plug 170 is shown in FIG. 10A. A representative perspective view of improved receptacle 810 is shown in FIG. 10A. Improved finger spring 847 is constructed of conductive member 841 physically coupled to resistive member 849, as shown in area 10C of FIG. 10B, and also in FIG. 10C, which is an enlarged fragmentary perspective view of area 10C. A protrusion 881 having jagged edges is inserted into a mating slot of resistive member 849. Embodiments of the slot in resistive member 849 include ribs to retain the resistive member after insertion. Other methods of physically coupling are also contemplated. The conductive member 841 is coupled to an electrical component, for example, by soldering into a through-hole of a circuit board the end of member 841 that is remote from resistive member 849. The mating finger pad 131 is coupled to an electrical component similarly by soldering the end of 131 that is remote from mating connector 810 into a through-hole on a circuit board. The improved finger spring 847 is shown in FIG. 10B. As plug 170 is inserted into receptacle 810, an outer substantially rectangular guide 132 is inserted into an exterior substantially rectangular guide 842, causing contact between shield 132 and guide 851. In some embodiments guide 851 is a metallic grounding spring. In other embodiments it is simply a spring or a piece of plastic. In some embodiments guides 132 and 842 are conductive shields. In other embodiments, one or more of 132 and 842 are constructed of insulating material, as an ESD solution has been incorporated into each lead of the connection. In some embodiments, an inner insulating guide 844 encompasses an exterior side of a finger spring 847. The insulating guides 844 and 134 serve to align lead 847 and lead 131. The guides are formed, for example from molded plastic. When guide 842 or 132 are conductive, they are formed for example, by taking a sheet of conductive material, such as metal, stamping a pattern out of the metal, and folding the result into a substantially rectangular shell. The folded shell forming shield 842 is fastened to insulator 844 with screws. Insulator 134 is fastened to shield 132 with screws. As plug 170 is partially inserted into receptacle 810, resistive member 849 initially contacts finger pad 831 providing a charge dissipation path from the component coupled to finger pad 831 through resistive member 849 to conductive member 841, and thus to the component electrically coupled to member 841. When plug 170 is further inserted into receptacle 810, conductive member 841 makes physical contact with finger pad 831, thus providing a bypass conductive path around resistive member 849 from the component attached to pad 831 to the component attached to member 841. This bypass path carries current during normal operation after connection is complete. In a similar manner, at approximately the same time finger pads 133, 135, and 137 make contact with finger springs 845, 843 and 861 respectively. In other embodiments, the finger pads, such as finger pad 131, are replaced with finger pads that have resistive members forming the tip, and conventional mating finger springs, such as lead 141, are used to form an improved connection.

Figure 11:
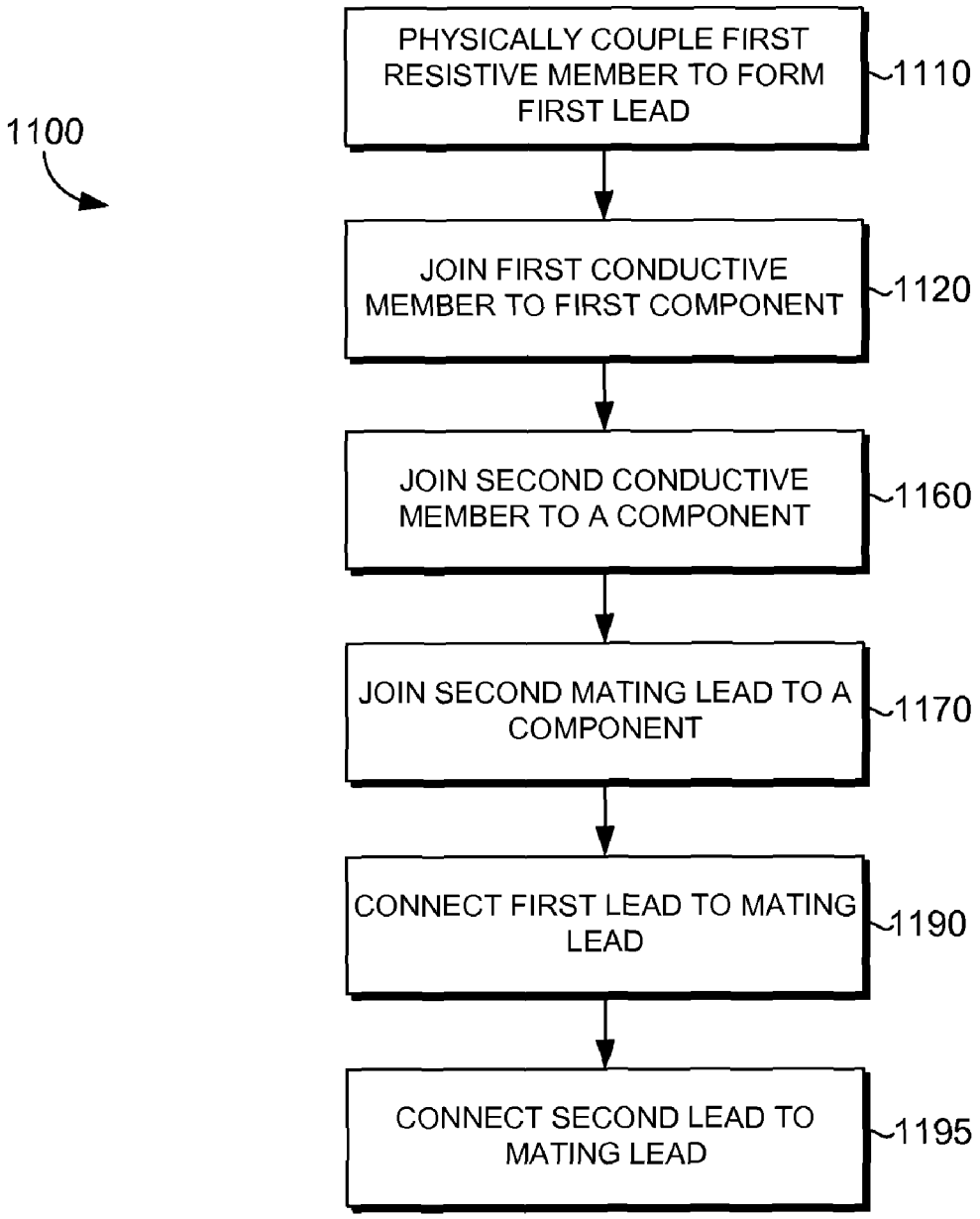
FIG. 11 is a flow diagram illustrating an exemplary process for providing a charge dissipation path used during connection of an electrical device.

Turning now to FIG. 11, there is presented in 1100 an exemplary process for providing a charge dissipation path used during connection of an electrical device. This process will be described in relation to exemplary application depicted in FIG. 9, using an improved barrel receptacle, such as lead 210, and a conventional plug 120. At 1110, a resistive member, such as resistive member 216, is physically coupled to a conductive member, such as conductive member 211, to form a first lead, such as lead 210. The physical coupling method used could be physical compression, adhesion, insertion, or screw-type. At 1120, the improved connector 210 is joined to a component, such as a battery 701 by forming a solder joint between lead 703 so that receptacle 710 is an improved receptacle lead, such as lead 210. A mating connector, such as lead 120 is joined to a component 702, such as an ESC by forming a solder joint between lead 705 and conductive interface 122. If desired, a piece of insulating shrink tube 249 is cut to cover lead 703 and connector lead 710, and heat is applied to shrink tube 249 to form an insulating jacket, such as jacket 218. Excess shrink tube is trimmed away, especially that which might obstruct the opening of the connector lead 710. If desired, a second resistive member, such as resistive member 216, is coupled to a second conductive member, such as conductive member 211, to form a second improved barrel receptacle, such as lead 210. Alternatively a conventional receptacle 110 is used. At 1160, second receptacle, such as lead 210, is joined to lead 704 by forming a solder joint to conductive interface 212, so that receptacle 720 is an improved lead, such as lead 210. At 1170, a mating lead, such as lead 120, is joined through a solder joint to a lead 706 and thus joined to a device such as ESC 702 and to a component such as capacitor 750. A piece of shrink tube is installed for lead 720 as described above. If desired, an insulating guide, such as guide 844, is physically mounted to leads 703 and 704 to hold the leads at a fixed separating distance during connection, and an insulating guide, such as guide 134, is physically mounted to leads 705 and 706 to hold the leads at approximately the same fixed separating distance during connection. If desired, the insulating guide 844 is surrounded by a second chassis ground shield, such as shield 842, and insulating guide 134 is surrounded by a second chassis ground shield, such as shield 132. At 1195, second lead 720 is connected to lead 740. At 1190 first lead 710 is connected to lead 730. Embodiments of steps 1190 and 1195 occur in reverse order. Embodiments of steps 1190 and 1195 occur at approximately the same time. The description here covers variations in this process including, for example, switching components so that barrel 210 is attached to lead 705 and plug 120 is attached to lead 703, using any improved lead plug and mating lead receptacle, or using any improved connector assembly that includes an improved lead.

The present invention has been described in relation to particular embodiments, which are intended in all respects to be illustrative rather than restrictive. Alternative embodiments will become apparent to those of ordinary skill in the art to which the present invention pertains without departing from its scope.

From the foregoing, it will be seen that this invention is one well adapted to attain all the ends and objects set forth above, together with other advantages which are obvious and inherent to the system and method. It will be understood that certain features and subcombinations are of utility and may be employed without reference to other features and subcombinations. This is contemplated by and is within the scope of the claims.

The invention claimed is:

1. An electrical connector assembly comprising:

a first conductive member having a conductive interface joinable to a first electrical polarity component of an electrical device, wherein said conductive interface, when joined to the first electrical polarity component, provides a current carrying path in an electrical device; and a resistive member physically coupled to said first conductive member forming, at least in part, a first connector lead;

wherein said first connector lead when physically connecting to a first mating connector lead attached to a second electrical polarity component:

(i) initially provides a charge dissipation path through said resistive member from said first electrical polarity component to said second polarity component, (ii) but subsequently provides a bypass, current carrying, conductive path around said resistive member from said first electrical polarity component to said second electrical polarity component.

2. The assembly of claim 1, wherein said connector lead is from the set consisting of a receptacle, a plug, a tab, a slot, a barrel plug, a barrel receptacle, a finger-spring, a finger pad, a pin, and a pin-hole.

3. The assembly of claim 1, further comprising said first mating connector lead.

4. The assembly of claim 1, wherein said first electrical polarity component is chosen from the set consisting of a battery, an electronic speed controller, a computer, and a universal serial bus device.

5. The assembly of claim 1 further comprising a second conductive member coupled to said resistive member protruding in the direction intended for said first mating connector lead, to form a front portion of said first connector lead.

6. The assembly of claim 2, further comprising an insulating jacket encompassing an exterior region of said first conductive member.

7. The assembly of claim 1, wherein said resistive member initially provides a resistance value in said charge dissipation path that is found in an interval between 3 times the reciprocal of the input capacitance and 0.000003 times the reciprocal of the input capacitance.

8. The assembly of claim 1, wherein said resistive member is made from a material chosen from the set consisting of a ceramic, a semiconductor and a polymer.

9. The assembly of claim 1, further comprising a second conductive member having a conductive interface to said first polarity component forming at least in part a second connector lead.

10. The assembly of claim 9, further comprising a conductive shield encompassing said first connector lead and said second connector lead.

11. The assembly of claim 6 wherein said insulating jacket serves as at least part of a guide to align said first connector lead when physically connecting to said first mating connector lead.

12. An electrical connector assembly for connecting a first component to a second component in a hobby application, other electrical application, or electronics application comprising:

a first conductive member having a solder joint interface to a lead of a first electrical polarity component of an electrical device, wherein said solder joint interface, when joined to the first electrical polarity component, provides a current carrying path in an electrical device; and a resistive member comprising a polymer physically coupled to said first conductive member forming, at least in part, a first connector lead;

wherein said first connector lead when physically connecting to a first mating connector lead attached to a second electrical polarity component:

(i) initially provides a charge dissipation path of resistance approximately matched to the input capacitance through said resistive member from said first electrical polarity component to said second polarity component, (ii) but subsequently provides a bypass current carrying, conductive path around said resistive member from said first electrical polarity component to said second electrical polarity component.

* * * * *